United States Patent [19]

Schroder

[11] Patent Number: 4,688,407

[45] Date of Patent: Aug. 25, 1987

[54] METHOD AND APPARATUS FOR RADIAL EXPANSION OF RINGS

[75] Inventor: Horst Schroder, Welver, Fed. Rep. of Germany

[73] Assignee: Maschinenfabrik J. Banning AG, Fed. Rep. of Germany

[21] Appl. No.: 779,820

[22] Filed: Sep. 25, 1985

[30] Foreign Application Priority Data

Sep. 26, 1984 [DE] Fed. Rep. of Germany ..... 3435209

[51] Int. Cl.[4] ..... B21J 13/08; B21D 3/14

[52] U.S. Cl. ..... 72/111; 72/420

[58] Field of Search ..... 72/105, 133, 111, 220, 72/420, 426, 86, 87, 109, 80, 101, 377; 51/88

[56] References Cited

U.S. PATENT DOCUMENTS

| | | | |
|---|---|---|---|
| 363,843 | 5/1887 | Munton | 72/109 |
| 401,713 | 4/1889 | Munton | 72/109 |
| 1,041,279 | 10/1912 | Heinsohn et al. | 72/105 |
| 1,219,174 | 3/1917 | Sessions | 72/105 |
| 1,268,239 | 6/1918 | Gressle | 72/111 |
| 3,142,207 | 7/1964 | Grob | 72/80 |

FOREIGN PATENT DOCUMENTS

| | | | |
|---|---|---|---|
| 1300503 | 8/1969 | Fed. Rep. of Germany | 72/420 |
| 48445 | 4/1980 | Japan | 72/420 |
| 1061807 | 3/1967 | United Kingdom | 72/379 |

*Primary Examiner*—Lowell A. Larson
*Attorney, Agent, or Firm*—Reese Taylor

[57] ABSTRACT

In a method for the radial expansion of rings, in particular by means of rolling tools, it is provided in accordance with the invention that the radial surfaces and the end faces of the ring that is to be machined are machined in alternation using the same pair of tools. The apparatus for performing the method includes a ring rolling machine in which the ring that is to be formed rests on a support that is pivotable by 90° to alternatively bring the radial surfaces and the end faces of the ring into engagement with the tools.

4 Claims, 3 Drawing Figures

1
2
3
4
5
6

METHOD AND APPARATUS FOR RADIAL EXPANSION OF RINGS

RELATED APPLICATIONS

This application claims priority under 35 U.S.C. 119 based on Federal Republic of Germany Application P34 35 209.0 filed Sept. 26, 1984.

BACKGROUND OF THE INVENTION

The present invention relates to a method and an apparatus for radially expanding or enlarging rings, in particular by means of rolling tools.

Methods of this general kind, in which ring blanks of steel or similar materials are rolled until the desired ring diameters and widths are attained, are known in the art.

Apparatuses are also known in which the ring blank rests with its inner radial surface on a rolling mandrel and with one end face on a rolling table. To center and hold the ring blank, rollers disposed on movable arms are pressed laterally against the outer annular face. A further roller, which is the main roller, presses against the outer radial surface of the ring blank opposite the rolling mandrel. When the apparatus is in operation, the ring travels between the main roller and the rolling mandrel so as to be rolled to the desired diameter. As a result of the rolling of the radial surfaces, however, the end faces are drawn concavely inward, resulting in a fish-mouth shaped deformation. The fish-mouth deformation is then removed later, on a second machine.

In order to overcome the disadvantage of fish-mouth deformation without using a second machine, apparatuses are used which have one pair of tools that machines the radial surfaces and another pair of tools that simultaneously rolls the end faces.

Such machines are very expensive, however, because they have two differently embodied pairs of tools which must each be controlled.

SUMMARY OF THE INVENTION

It is accordingly the object of the present invention to embody a method of the above-described general type in such a way that the advantages of the methods and apparatuses known in the art are retained, yet their disadvantages are eliminated.

The invention attains this object by providing that the same pair of tools alternatively forms the radial surfaces and the end faces of the ring that is to be expanded.

This method saves time, because during forming the ring can always remain on the same apparatus. Furthermore, because forming is performed by the same pair of tools, the apparatus for performing the method can be compact in structure and relatively inexpensive.

In an advantageous embodiment of an apparatus, in which the radial surfaces of the ring that are to be formed travel between two tools, for instance a main roller and a rolling mandrel, and the ring that is to be formed rests with one end face on a flat support, the invention provides that the flat support is pivotable, together with the ring resting on it, about an angle of 90°, so that after pivoting, the end faces of the ring are located between the tools of the pair.

If the end faces, after the radial surfaces have been rolled, have become slightly indrawn into a fish-mouth shape, then the support and ring are pivoted so that the end faces can be rolled. Then the ring, along with the support, is pivoted back into the original position, and the process is repeated until such time as the ring has the desired dimensions, yet exhibits no fish-mouth deformation.

The invention will be explained in greater detail below, referring to the drawings.

OF THE DRAWINGS

BRIEF DESCRIPTION OF THE PREFERRED EMBODIMENT

Figures 1, 2, 3:
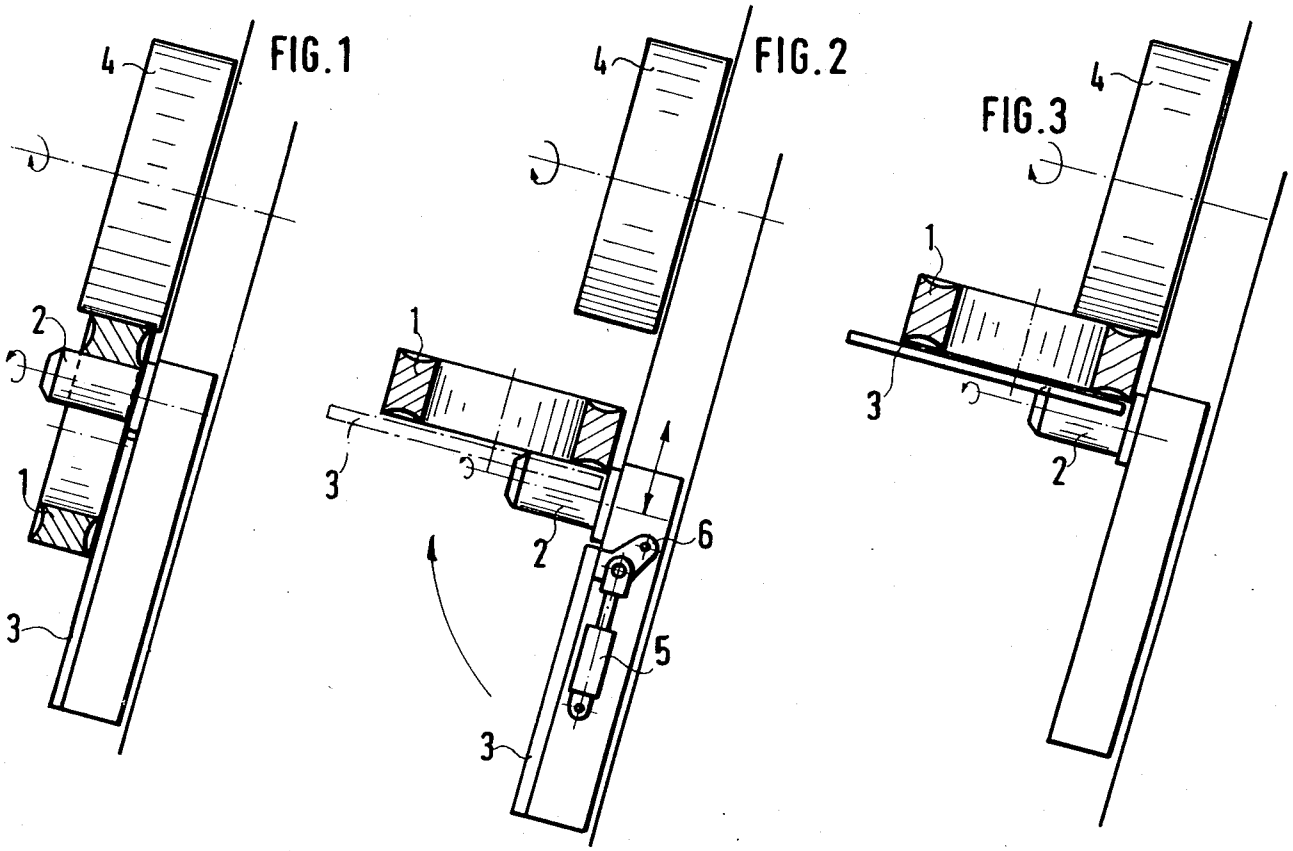
FIG. 1 is a side view of a portion of the apparatus, showing the forming of the radial surfaces.
FIG. 2 is a side view of a portion of the apparatus, showing the pivoting operation.
FIG. 3 is a side view of a portion of the apparatus, showing the forming of the end faces.

In the drawings, for the sake of simplicity and ease of comprehension, only the essential portion of a rolling machine has been shown in FIGS. 1 through 3. The ring that is to be rolled is identified by reference numeral 1.

In FIG. 1, the ring 1 rests with its inner radial surface on a rolling mandrel 2. The lower end face of the ring 1 rests on a support 3, hereinafter called the rolling table. A tool, hereinafter called the main roller 4, rests on the outer radial surface of the ring 1. The rolling table 3 is illustrated as pivoted about an axis 6 (See FIG. 2) into a position that is located 90° from the original position by means of a thrust piston mechanism 5; however, other kinds of swivel carriage or rotary table are possible as well. To facilitate pivoting, the rolling table 3 has a central opening (not shown) such that the rolling mandrel 2 will not collide with the rolling table 3 during the pivoting operation.

It should also be noted that the distance by which the rolling mandrel 2 and the main roller 4 are spaced apart is variable.

As shown in FIGS. 1 through 3, a ring 1 is first rolled while the rolling table 3 is in an almost vertifal position. The main roller 4 and the rolling mandrel 2 roll the opposed radial sides of the ring 1. As a consequence, the end faces of the ring 1 bend concavely into a so-called fish-mouth. In order to smooth out the end faces as well, the rolling table 3 together with the ring 1 is pivoted by 90°. To this end, the rolling mandrel 2 along with the rolling table 3 must first be moved downward with respect to main roller 4, to increase the distance between the rolling mandrel 2 and the main roller 4. Once the ring has attained its new position as shown in FIG. 2 and the rolling table 3 is pivoted by mechanism 5, the rolling mandrel 2 together with the rolling table 3 is moved upward, until ring ring 1 rests with its end faces firmly between the tool pair 2, 4. Now the "fish-mouth" can be removed. Subsequently, the ring 1 is pivoted back again by 90°, and the rolling operation described above is repeated until such time as a ring 1 of desired size and shape has been produced.

While a full and complete description of the invention has been set forth in accordance with the Patent Statutes, it will be understood that modifications can be resorted to without departing from the spirit hereof of the scope of the appended claims.

What is claimed is:

1. A method for the radial expansion of rings, in particular by means of rolling tools, comprising the steps of:

(A) positioning the radial surfaces of said ring between the rolling tools;

(B) rolling said radial surfaces;

(C) repositioning the ring by movement thereof about 90° to dispose of the edge surfaces thereof between the same rolling tools;

(D) rolling said edge surfaces; and (E) repeating steps A–D until the cross-section of the ring is substantially rectangular.

2. The method of claim 1 further characterized by moving one of said tools radially away from the other prior to repositioning said ring in step C and moving the said one tool radially back toward the other prior to step D.

3. Apparatus for the radial expansion of rings having radial surfaces and opposed end faces, comprising:

(A) a support member;

(B) a main roller mounted on said support member for rotation about an axis substantially normal to the plane of said support member for normally engaging one radial surface of the ring;

(C) a rolling mandrel mounted on said support member for rotation about an axis substantially parallel to the axis of rotation of said main roller for normally engaging the other radial surface of the ring;

(D) a movable support surface mounted on said support member and movable through an arc of about 90° to move said ring to a position wherein said main roller engages one end face of the ring and said rolling mandrel engages the opposed face thereof; and (E) means carried by said support member for moving said rolling mandrel and said support surface toward and away from said main roller.

4. In a rolling machine for the radial expansion of rings wherein the radial surfaces of the ring that are to be formed by travel between two tools, a main roller and a rolling mandrel carried on a support member, and the ring that is to be formed rests with its end face on a flat support and its radial surfaces exposed to the main roller and the rolling mandrel, the improvement comprising:

(A) said flat support (3), together with the ring (1) resting on it, being pivotally supported on the support member for pivoting through an arc of about 90° whereby, after the pivoting operation the end faces of the ring (1) are located between the pair of tools (2, 4); and (B) said rolling mandrel (2) and said flat support (3) being movable radially away from and back toward the main roller (4).

* * * * *